US005551385A

United States Patent [19]

Yoshida et al.

[11] Patent Number: 5,551,385

[45] Date of Patent: Sep. 3, 1996

[54] INTAKE SYSTEM INSULATOR FOR OUTBOARD MOTOR

[75] Inventors: Sadato Yoshida; Hiroshi Nakai; Akihiko Hoshiba; Yasuhiko Shibata, all of Hamamatsu, Japan

[73] Assignee: Sanshin Koygo Kabushiko Kaisha, Hamamatsu, Japan

[21] Appl. No.: 302,184

[22] Filed: Sep. 8, 1994

[30] Foreign Application Priority Data

Sep. 8, 1993 [JP] Japan ..... 5-247583

[51] Int. Cl.[6] ..... B63H 21/26

[52] U.S. Cl. ..... 123/184.21; 123/184.61

[58] Field of Search ..... 123/184.21, 184.61, 123/192.1, 41.31, 541, 22, 590, 593; 261/1

[56] References Cited

U.S. PATENT DOCUMENTS

| | | | |
|---|---|---|---|
| 1,953,809 | 4/1934 | Kenneweg | 123/541 |
| 2,072,862 | 3/1937 | Balfe | 123/22 |
| 2,085,574 | 6/1937 | Chandler | 261/1 |
| 2,397,392 | 3/1946 | Weber | 261/1 |
| 3,332,476 | 7/1967 | McDougal | 123/41.31 |
| 3,509,860 | 5/1970 | Ferriday | 123/593 |
| 4,716,878 | 1/1988 | Shimada et al. | 123/184.61 |
| 5,353,752 | 10/1994 | Suzuki | 123/184.61 |

FOREIGN PATENT DOCUMENTS 2-274690 11/1990 Japan .

*Primary Examiner*—Marguerite McMahon
*Attorney, Agent, or Firm*—Knobbe, Martens, Olson & Bear

[57] ABSTRACT

An insulator supports a plurality of charge formers on the end of an intake manifold. The insulator, made in part of elastic material, thermally decouples the charge formers from the engine to reduce conduction of engine heat to the charge formers. Expansion of the intake manifold due to heat deforms the insulator, without substantially moving the charge formers so as not to deform a linkage which interconnects the charge formers.

22 Claims, 9 Drawing Sheets

INTAKE SYSTEM INSULATOR FOR OUTBOARD MOTOR

BACKGROUND OF THE INVENTION

1. Field of the Invention

The present invention relates in general to a marine engine, and more particularly to an insulator for a charge former of the engine.

2. Description of Related Art

Conventional internal combustion engines, which power an outboard drive, typically include at least one charge former to produce a fuel charge which is delivered to the combustion chambers of the engine through an intake manifold. The charge former commonly is directly connected to the intake manifold of a cylinder head to reduce the length of the induction passage.

Many types of charge formers are sensitive to heat in that if the charge former becomes highly heated, the fuel within the charge former boils and vaporizes. As a result, the charge former does not produce a fuel charge containing the proper air/fuel mixture.

A direct mechanical connection between the charge former and the intake manifold provides a thermal conductive pathway between these components. Heat from the highly heated intake manifold easily conducts to the charge former through the direct mechanical connection and heats the fuel.

To combat this problem, prior engine designs have placed an insulator between the charge former and the cylinder head to insulate the charge former from such conductive heat. With prior insulators, however, the charge former and the intake manifold must still be bolted together. This direction connection, however, in itself forms a thermal conductive pathway between the intake manifold and the charge former, which by-passes the insulator. Although the insulator impedes to some extent conductive heat transfer between the intake manifold and charge former, the insulator does not completely isolate the charge former from such conductive heat.

Many engine designs also employ a plurality of charge formers which are linked together by one or more linkage systems. These charge formers commonly are directly connected to a common mounting flange of an intake manifold.

Because prior linkages typically expand at a different expansion rate than the intake manifold, thermal expansion of the intake manifold tends to warp the linkages. As the intake manifold expands with increased temperature, the charge formers move and the distance between the charge forms changes. The movements between the charge formers of course affects the linkages.

In the case of a throttle linkage, which interconnects a plurality of throttle valves of the charge formers, such warpage of the throttle linkage commonly varies the position of one or more of the throttle valves. The throttle valves thus become unsynchronized and engine revolution becomes unstabilized.

SUMMARY OF THE INVENTION

A need therefore exists for an insulator for interposition between a charge former and a heated portion of an intake system which effectively decouples the charge former from the effects of thermal expansion of the heated intake system and from heat conduction from the intake system.

In accordance with an aspect of the present invention, an insulator couples at least one charge former to an intake conduit. The insulator includes a rigid support member for direct mechanical connection to the intake conduit and at least one rigid mounting member for direct mechanical connection to the charge former. An elastic insulator member is interposed between the support member and the mounting member, and forms the sole connection joining the support and mounting members together.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF A PREFERRED EMBODIMENT

Figure 1:
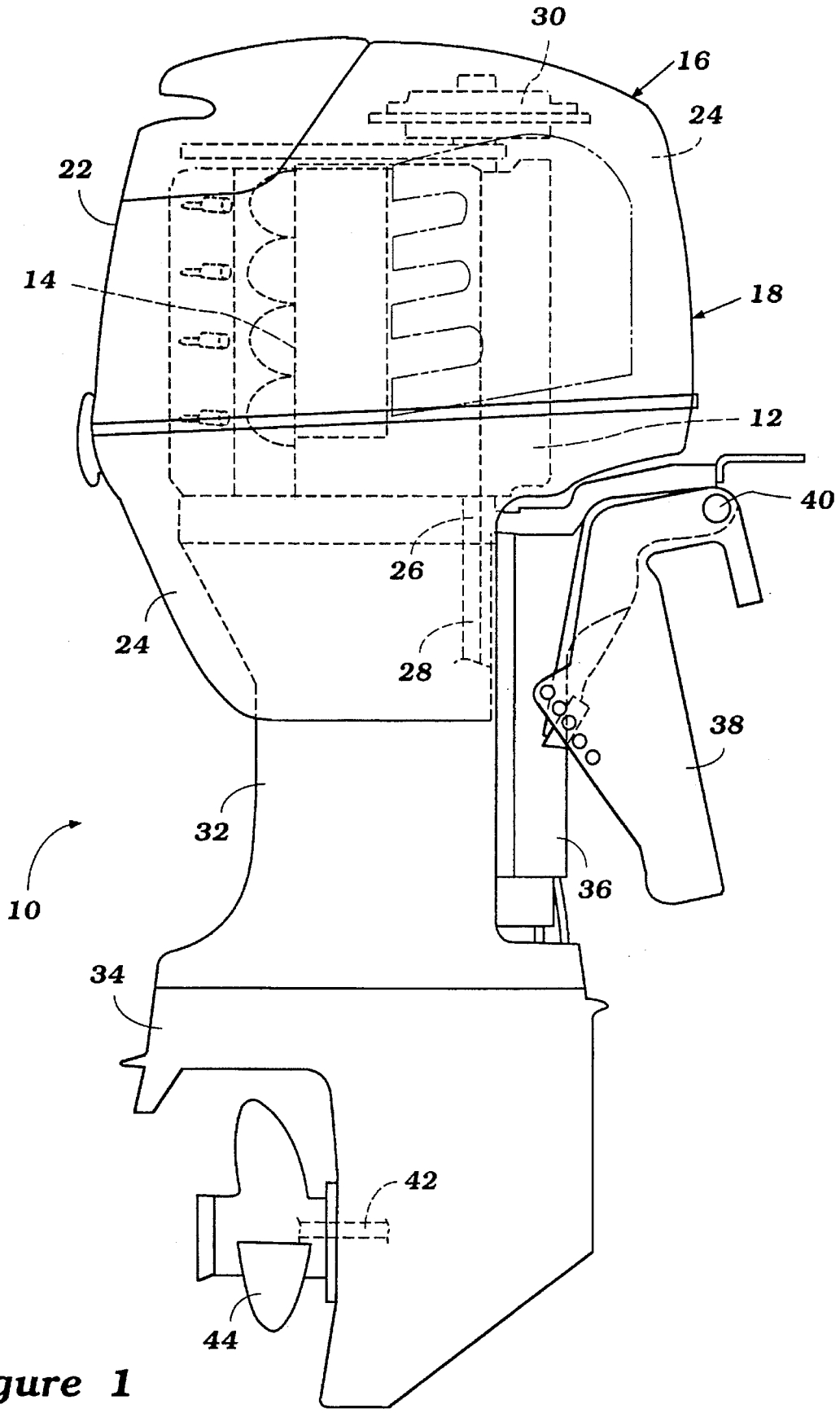
FIG. 1 is a side elevational view of a marine outboard motor which incorporates an intake system insulator for an engine which is configured in accordance with a preferred embodiment of the present invention.

FIG. 1 illustrates a marine outboard drive 10 having an internal combustion engine 12 which incorporates an intake system insulator 14 configured in accordance with a preferred embodiment of the present invention. Though it is understood that the present intake system insulator 14 can be incorporated with any type of internal combustion engine, the present invention is particularly well suited for application in conjunction with a vertically oriented engine of a marine outboard motor. It is contemplated, however, that certain aspects of the invention can be employed with engines having other orientations and applications.

In the illustrated embodiment, the outboard drive 10 has a power head 16 formed in part by the engine 12. The engine 12 desirably is a four-stroke, in-line, four-cylinder combustion engine. It will be readily apparent to those skilled in the art, however, that the present intake system insulator 14 may be employed with engines having other number of cylinders, having other cylinder orientations, and/or operating on other than a four-stroke principal.

A protective cowling 18 of a known type surrounds the engine 12. The cowling 18 desirably includes a lower tray 20 and a top cowling member 22. These components 20, 22 of the protective cowling 18 together define an engine compartment 24 which houses the engine 16.

As seen in FIG. 1, the engine 16 is mounted conventionally with its output shaft 26 (i.e., crankshaft) rotating about a generally vertical axis. The crankshaft 26 is suitably journaled within the engine 12 and drives a drive shaft 28. The drive shaft 28 depends from the power head 14 of the outboard drive 10. A standard magneto generator/flywheel assembly 30 is attached to the upper end of the crankshaft 24.

As seen in FIG. 1, a drive shaft housing 32 extends downward from the lower tray 20 and terminates in a lower unit 34. A steering bracket 36 is attached to the drive shaft housing 32 in a known matter. The steering bracket 36 also is pivotably connected to a clamping bracket 38 by a pin 40. The clamping bracket 38, in turn, is configured to attach to a transom of the watercraft (not shown). This conventional coupling permits the outboard drive 10 to be pivoted relative to the steering bracket 36 for steering purposes, as well as to be pivoted relative to the pin 40 to permit, adjustment to the trim position of the outboard drive 10 and for tilt up of the outboard drive 10.

Although not illustrated, it is understood that a conventional hydraulic tilt and trim cylinder assembly, as well as a conventional hydraulic steering cylinder assembly could be used as well with the present outboard drive. It is also understood that the above description of the construction of the outboard drive is conventional, and, thus, further details of the steering, trim, and mounting assemblies are not necessary for an understanding of the present invention.

As schematically illustrated in FIG. 1, the drive shaft 28 extends through and is journaled within the drive shaft housing 32. A transmission (not shown) selectively couples the drive shaft 28 to a propulsion shaft 42. The transmission desirably is a forward/neutral/reverse-type transmission for driving the propulsion shaft 42 in selected forward and reverse directions.

The propulsion shaft 42 drives a propulsion device 44, such as, for example, a propeller, a hydrodynamic jet, or the like. In the illustrated embodiment, the propulsion device 44 is a single propeller; however, it is understood that a counter-rotational propeller device can be used as well.

Figure 2:
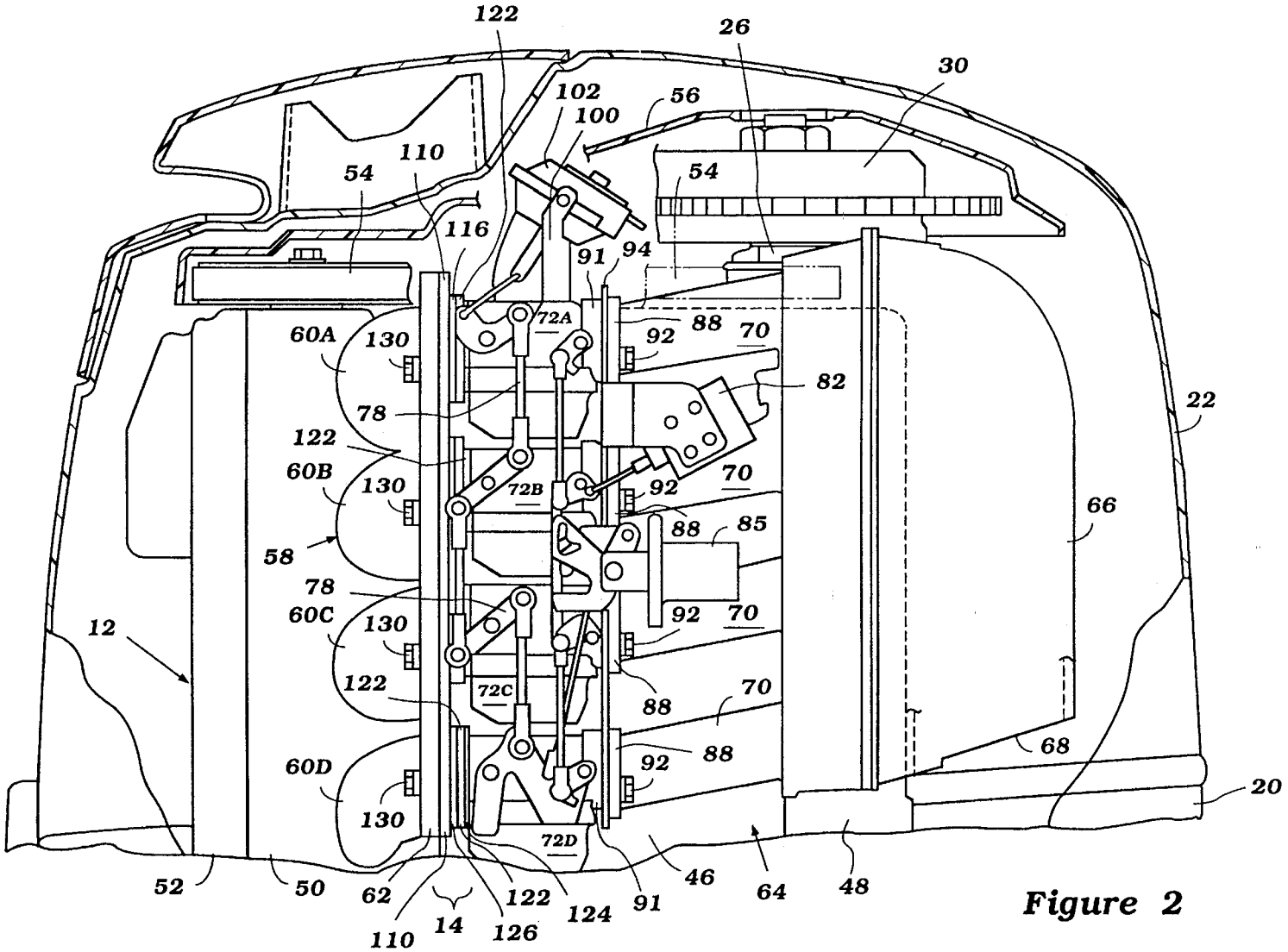
FIG. 2 is an enlarged, cut-away side elevational view of a power head of the marine outboard motor of FIG. 1.

With reference to FIG. 2, the engine 12 includes a cylinder block 46 which desirably defines four aligned cylinder bores (not shown). Pistons (not shown) reciprocate within the cylinder bores, and connecting rods (not shown) link the pistons and the crankshaft 26 together so that the reciprocal linear movement of the pistons rotates the crankshaft 26 in a known manner. A crankcase 48, attached to the cylinder block 46 by known means, surrounds at least a portion of the crankshaft 26 with the crankshaft 26 journaled therein.

On the opposite end of the cylinder block 46, a cylinder head 50 is attached. The cylinder head 50 has a conventional construction, and supports and houses an intake and exhaust valve system (not shown).

A cam cover 52 is attached to the cylinder head 50, on a side of the cylinder head 50 opposite of the cylinder block 46. The cam cover 52 and the cylinder head 50 together define a cam chamber in which a conventional valve operation mechanism is journaled. In the illustrated embodiment, the engine 12 includes an overhead camshaft (not shown) which operates the overhead intake and exhaust valve system. The crankshaft 26 drives the overhead camshaft via an external toothed timing belt 54, which is covered by an upper cover 56. Because the invention deals primarily with the insulator 14 between the intake system and an induction system of the engine 12, it is not believed necessary to discuss or describe in greater detail the particular valve system and valve operation mechanism of the engine 12.

Figure 3:
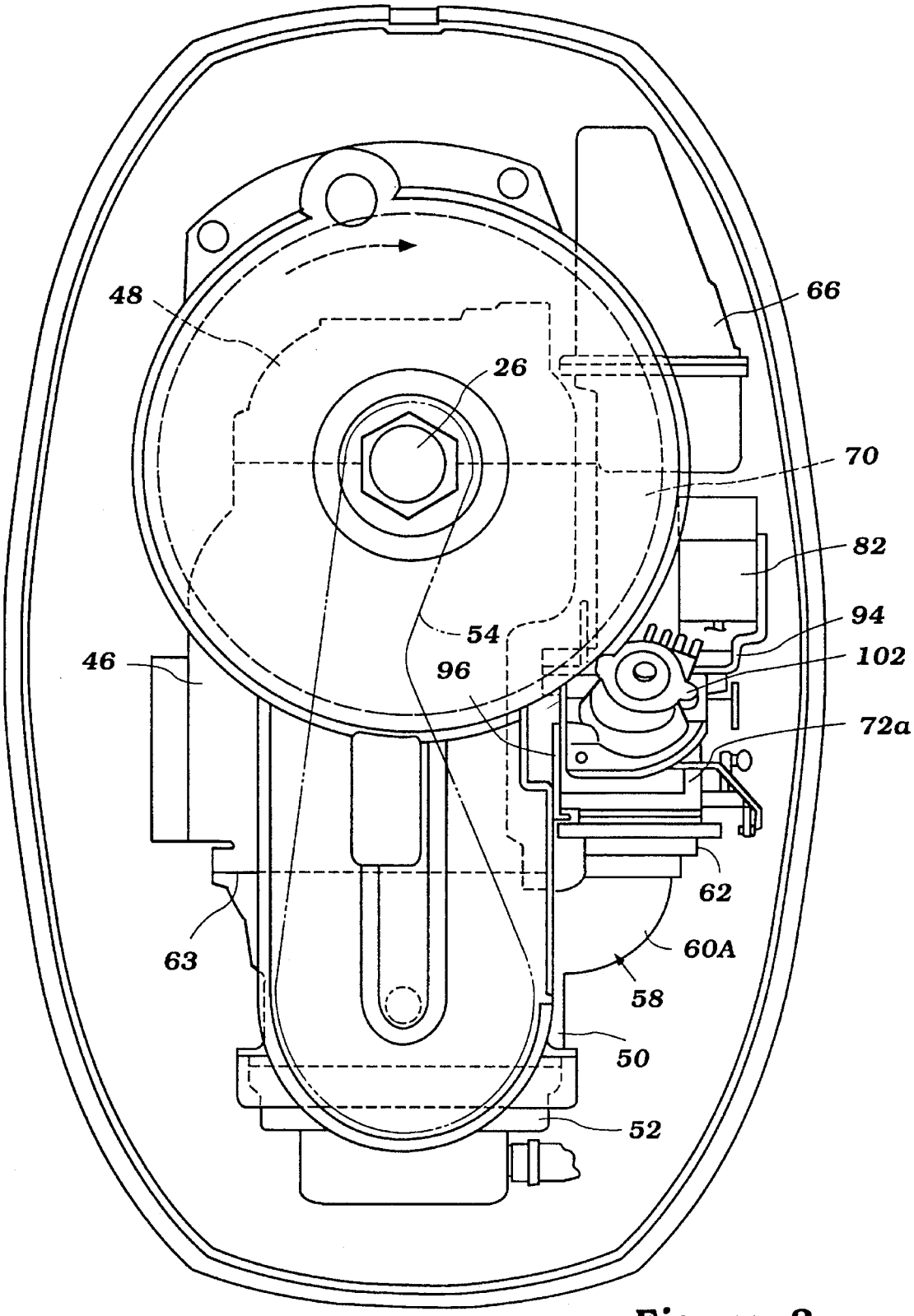
FIG. 3 is a top plan view of the power head of FIG. 2 with a top cowling of the power head removed to expose the engine.

As seen in FIGS. 2 and 3, the cylinder head 50 also includes an integral intake manifold 58 having a plurality of intake pipes 60. For ease of description, each intake pipe will be designated by an "a," "b" , "c" or "d" suffix, designated from the top down, and the intake pipes in general will be identified by reference numeral 60, without suffix. Each intake pipe 60 communicates with an individual combustion chamber of the engine 12 through the intake valve system. As best seen in FIG. 3, the intake manifold 58 extends from the cylinder head on the induction side of the engine 12, and terminates in a flange 62 that extends generally parallel to a sealing surface 63 of the cylinder head 50 which engages the cylinder block 46.

An induction system 64 of the engine 12 supplies a fuel/air charge to the individual combustion chambers through the intake manifold 58. The induction system 64 includes an intake silencer 66 having a downwardly facing air inlet 68 which is disposed to the front of the power head 16 and on one side of the crankcase 48. The intake silencer 66 draws air into the engine 12 from the interior of the cowling 18 and silences the intake air charge.

A series of induction pipes 70 deliver the air flow from the intake silencer 66 to a plurality of charge formers 72. The lengths of the induction pipes 70 desirably are tuned with the intake silencer 66 to minimize the noise produced by the induction system 64, as known in the art.

In the illustrated embodiment, the charge formers 72 are a plurality of carburetors placed above one another. It should be understood, however, that although the present intake system insulator 14 is described in conjunction with a carbureted engine, certain facets the of invention may be employed in conjunction with other types of charge formers, such as fuel injectors or the like. For ease of description, each carburetor will be designated by an "a," "b," "c," or "d" suffix, identified from the top down, and the carburetors in general shall be designated by reference numeral 72, without suffix.

Figure 4:
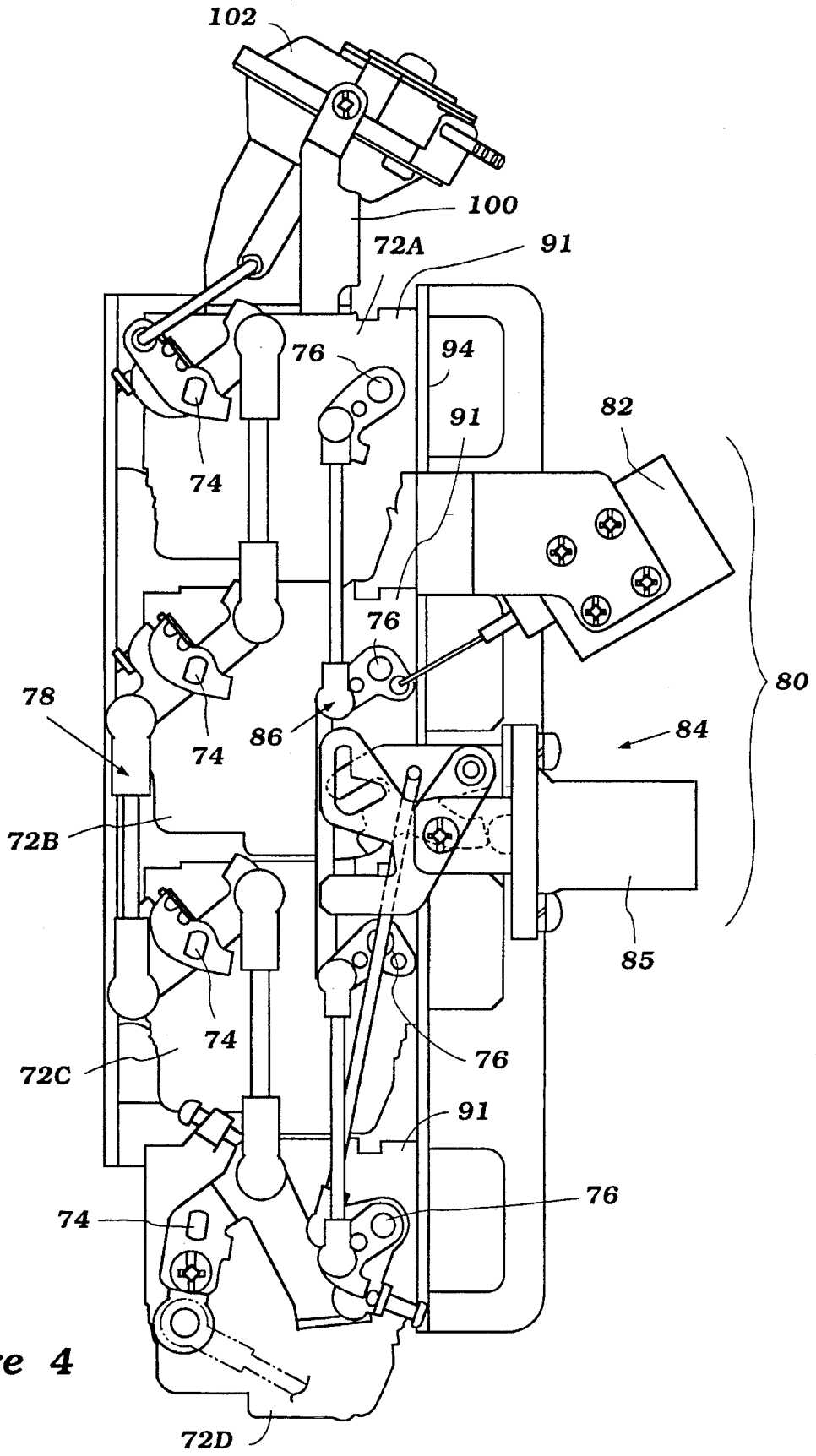
FIG. 4 is a side elevational view of a charge former assembly of the power head of FIG. 2.

The carburetors 72 may be of any known type and construction. In the illustrated embodiment, as best seen in FIG. 4 (which depicts the carburetors 72 generally isolated from the balance of the induction systems 64), each carburetor 72 includes a throttle valve (not shown) operated by a throttle shaft 74, and a choke valve (not shown) operated by a choke shaft 76. A throttle linkage 78 connects the throttle shafts 74 of the carburetors 72 together so as to move in unison. A suitable throttle linkage 78 is disclosed in U.S. patent application, Ser. No. 08/302,627, filed Sep. 8, 1994, in the names of Sadato Yoshida, Hiroshi Nakai, Akihiko Hoshiba, and Yasuhiko Shibata and assigned to the assignee hereof, which is hereby incorporated by reference.

With reference to FIGS. 2 and 4, a choke actuation system 80 desirably controls the operation of the choke shafts 76. A suitable choke actuation system 80 is disclosed in U.S. patent application, Ser. No. 08/302,170, filed Sep. 8, 1994, in the name of Akihiko Hoshiba and assigned to the assignee hereof, which is hereby incorporated by reference. As best seen in FIG. 4, the choke actuation system 80 includes a solenoid 82 to close the choke valves, and a choke control mechanism 84 to limit the extent to which the solenoid 82 can close the choke valves and to gradually open the choke valves as the engine warms from a cold start. The choke control mechanism includes an actuator 85 with a positive temperature coefficient (PCT) device for this purpose. The choke actuation system 80 also includes a choke linkage 86 which connects the choke shafts 76 of the carburetors 72 to the solenoid 82 and to the choke control mechanism 84.

Figure 5:
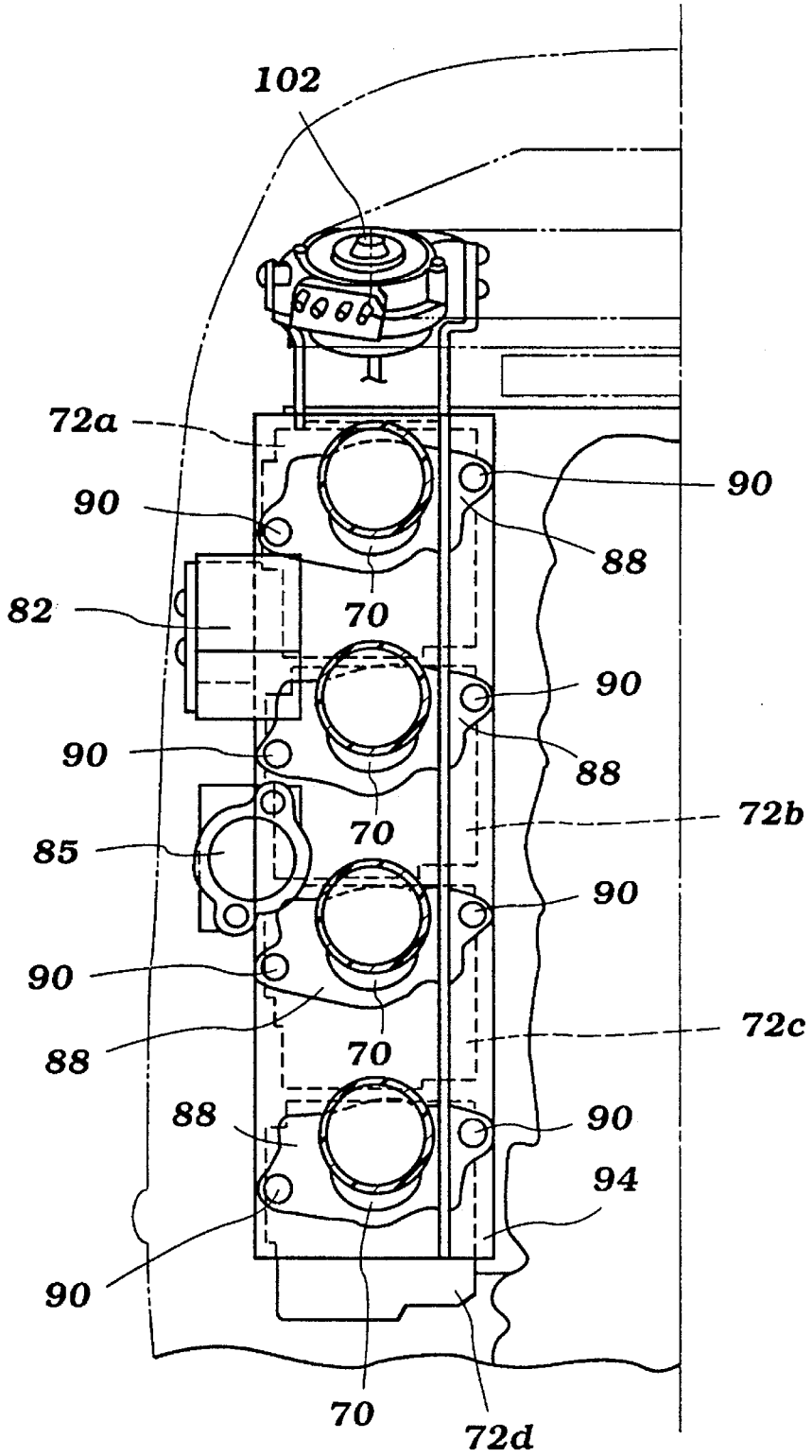
FIG. 5 is a cross-sectional view taken through a series of inlet pipes of an induction system of the power head of FIG. 2.

With reference to FIG. 2, the inlet sides of the carburetors 72 (i.e., the side proximate to the intake silencer 66) are mounted to an outlet end of an induction pipe 70. For this purpose, as best seen in FIGS. 2 and 5, each induction pipe 70 includes a mounting flange 88. Each flange 88 includes a pair of mounting holes 90 which cooperate with corresponding mounting holes formed in a inlet end flange 91 of the carburetor body 72. As best seen in FIG. 2, bolts 92 pass through the mounting holes of induction pipe flanges 88 and the carburetor inlet end flanges 91 to secure the induction pipes 70 and carburetors 72 together, as discussed in detail below.

As seen in FIGS. 2 and 5, a first mounting plate 94 is interposed between the carburetors flanges 91 and the induction pipe flanges 88 to interconnect all of the induction pipes 70 and carburetors 72. The first mounting plate 94 includes a plurality of spaced openings which correspond to the inlet openings of the carburetors 72 to allow the induction pipes 70 to communicate with the carburetors 72.

The first mounting plate 94 also includes several projecting support arms which support the solenoid 82 and choke control mechanism 84 of the choke actuation system 80. A detailed description of the support arms and the overall mounting plate 94 is provided in copending U.S. patent application Ser. No. 08/302,217, filed Sep. 8, 1994, in the names of Hiroshi Nakai, Akihiko Hoshiba and Yasuhiko Shibata and assigned to the assignee hereof, which is hereby incorporated by reference.

Figure 6:
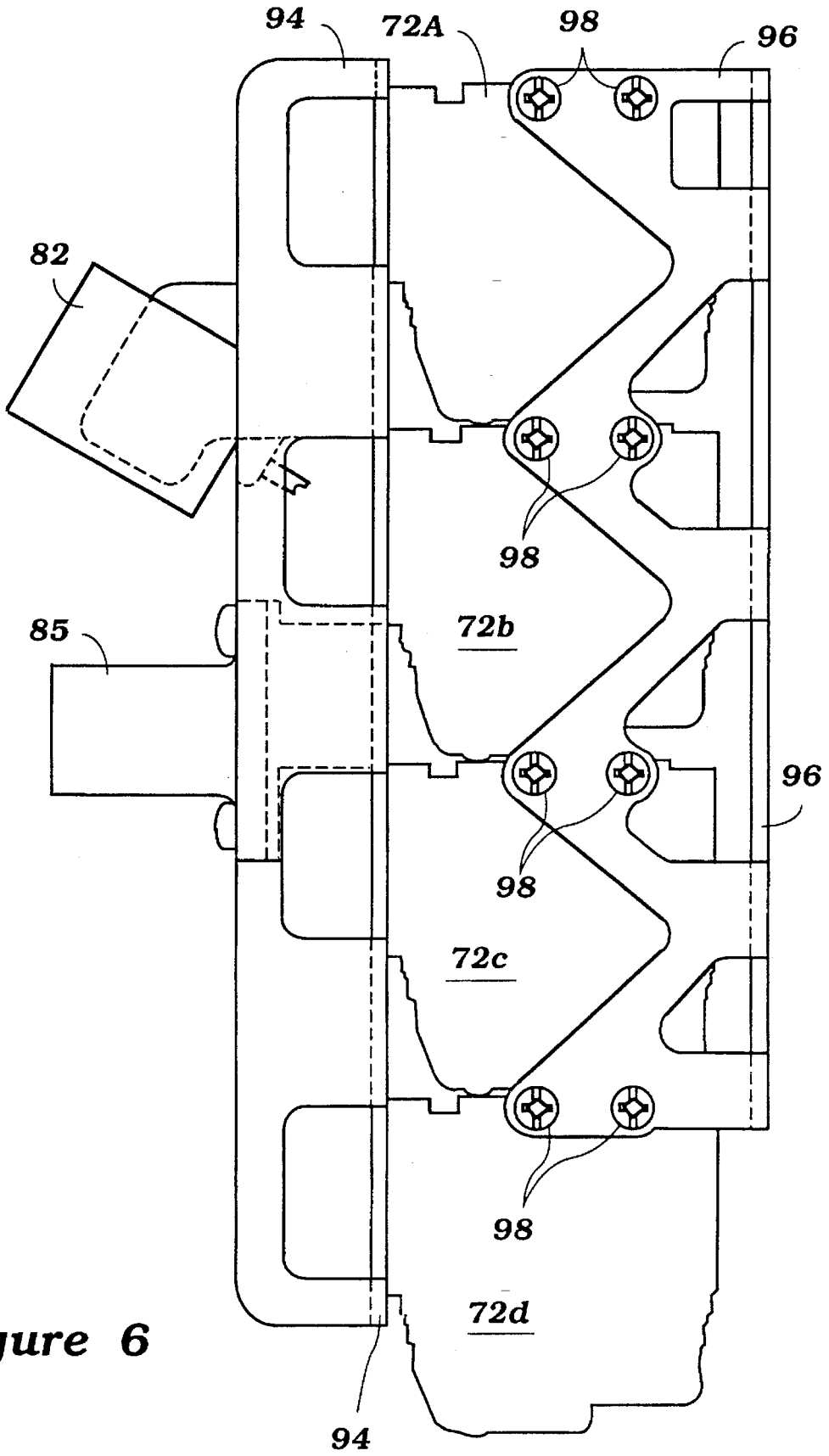
FIG. 6 an opposite side elevational view of the charge former assembly of FIG. 4.
Figure 7:
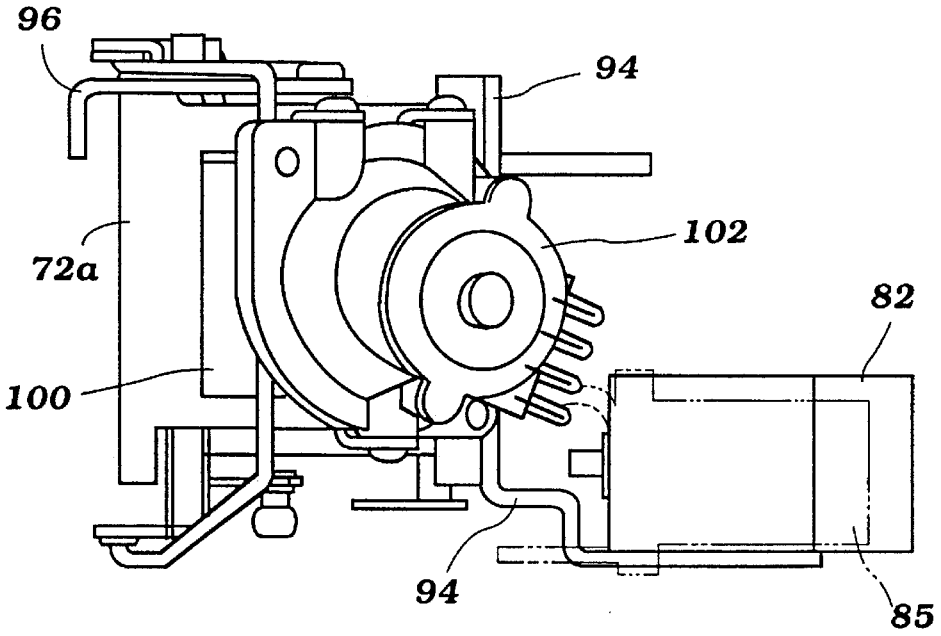
FIG. 7 is a top plan view of the charge former assembly of FIG. 4.
Figure 8:
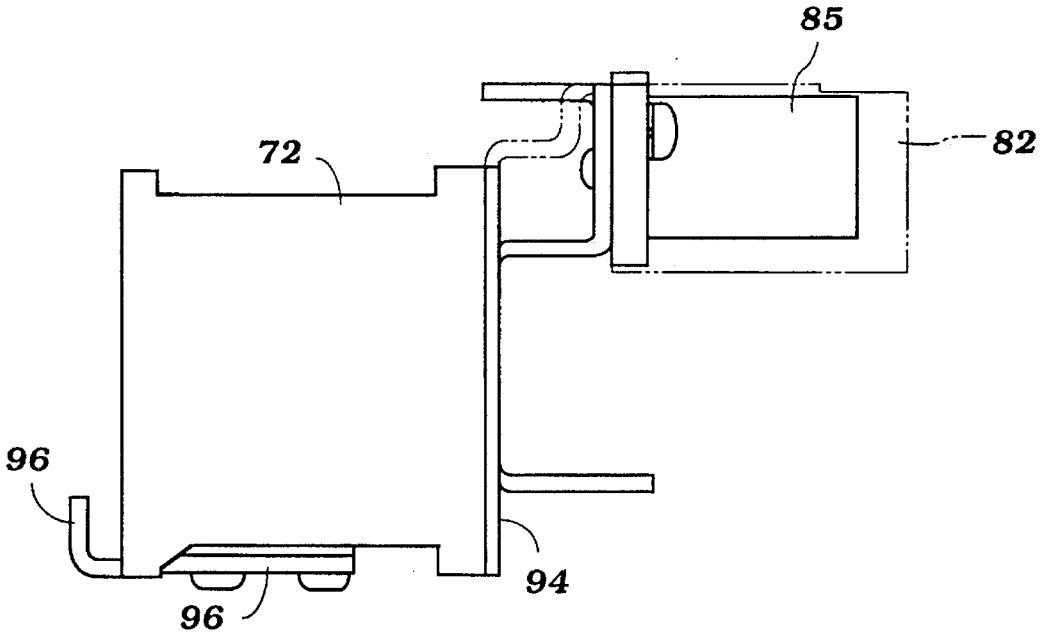
FIG. 8 is a bottom plan view of the charge former assembly of FIG. 4.

With reference to FIG. 6, a second mounting plate 96 joins together the outlet sides of the carburetors 72. Screws 98 secure the second mounting plate 96 to the back side of the carburetors 72 (i.e., the side of the carburetors 72 adjacent to the cylinder block 46); the position of the second mounting plate 96 in the engine 12 is best seen in FIG. 3. As seen in FIG. 2, the second mounting plate 96 also includes a support arm 100 which supports a conventional accelerator pump 102 above the top carburetor 72*a*. A linkage 104 couples the accelerator pump 102 to the throttle linkage 78. Although not shown to simplify the drawings, conventional fuel lines connect the accelerator pump 102 to the carburetors 72. FIGS. 7 and 8 further illustrate the assembly of the carburetors 72, the first and second mounting plates 96, 98, the accelerator pump 102, the solenoid 82 and the actuator 85.

As seen in FIG. 2, each carburetor 72 services a respective combustion chamber. For this purpose, the outlet side of each carburetor 72 is coupled to a corresponding intake pipe 60 of the cylinder head intake manifold 58 to place the carburetor 72 in communication with the respective combustion chamber.

The engine 12 of the outboard drive 10 so far described is generally typical of prior engine construction, with the exception of the above-noted carburetor mounting assembly, throttle linkage and choke actuation system, which are the subject of several other copending U.S. patent application which have been incorporated by reference. However, in accordance with an aspect of the present invention, the engine 12 incorporates the present intake system insulator 14 to physically couple the carburetors 72 to the intake manifold 58, but to substantially decouple the carburetors 72 from the thermal and vibrations effects of the cylinder head 50.

Figures 9A, 9B, 9C:
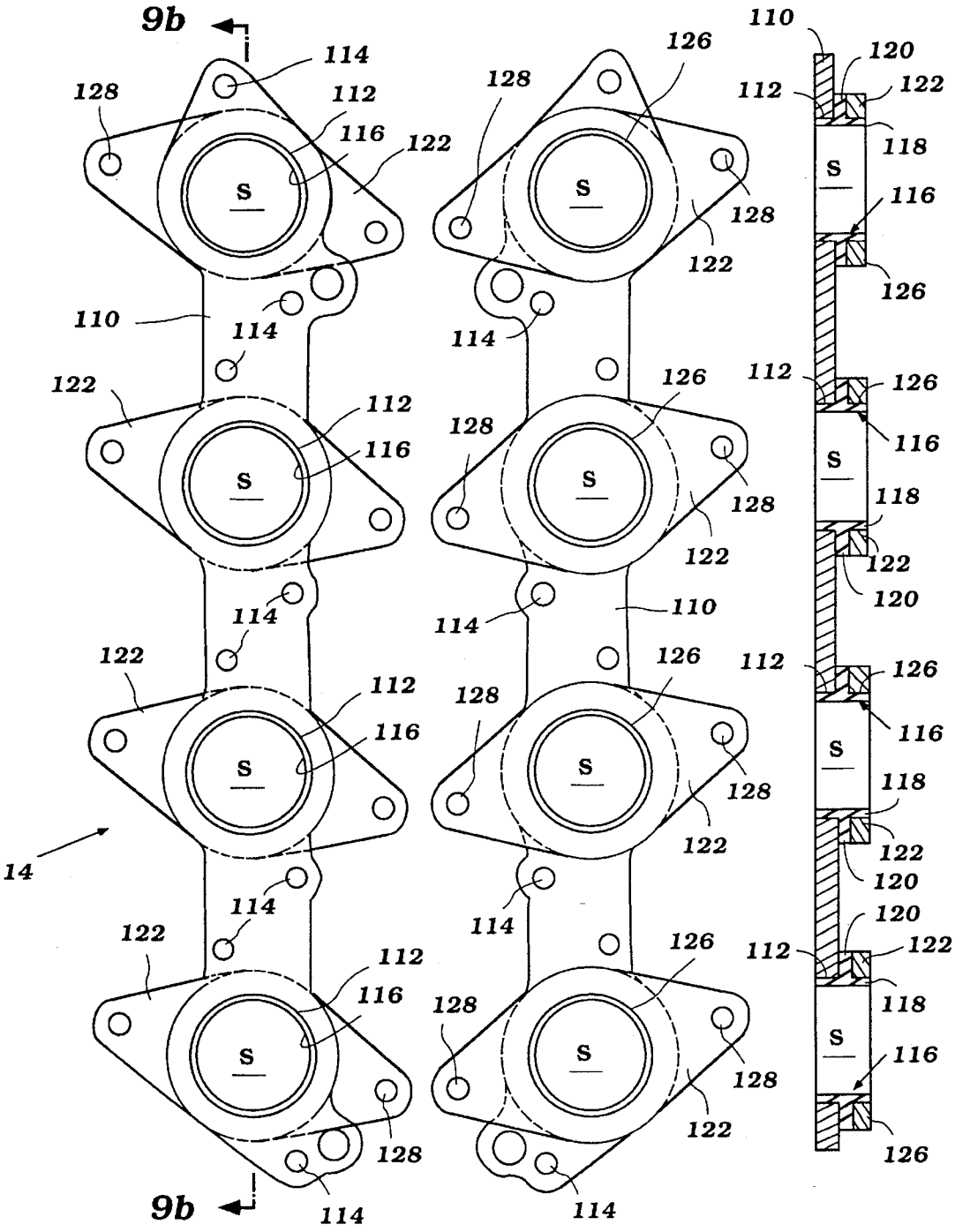
FIG. 9*a* is a side elevational view of an insulator in accordance with a preferred embodiment of the present invention, as viewed from an outlet side.
FIG. 9*b* is a cross-sectional view of the insulator of FIG. 9*a* taken along line 9*b*—9*b;*
FIG. 9*c* is a side elevational view of the insulator of FIG. 9*a* as viewed from an opposite inlet side.

FIGS. 9*a* through 9*c* illustrate an insulator 14 in accordance with a preferred embodiment of the present invention. FIG. 9*a* illustrates an elevational side view of the insulator 14 as seen from a side which is adjacent the intake manifold 58 in assembly; FIG. 9*b* is a cross-sectional view of the insulator 14 taken along line 9*b*—9*b* of FIG. 9*a*; and FIG. 9*c* illustrates the opposite side of the insulator 14 from that shown in FIG. 9*a*.

As best seen in FIG. 9*a*, the insulator 14 includes a support plate 110. The support plate 110 has a shape which is generally commensurate with the shape of the intake manifold flange 62. A plurality of openings 112 pass through the support plate 110. The spacing between the openings 112 generally corresponds with the inlet openings of the intake pipes 60. The openings 112 desirably have a size (e.g., a diameter) slightly larger than that of the intake pipes openings. The support plate 110 also defines a plurality of threaded mounting holes 114 which correspond with the position of through holes on the intake manifold flange 62. As seen in FIG. 9*a*, the mounting holes 114 are desirably arranged in pairings, with one hole of the pair positioned above one of the openings 112 and the other hole positioned below the opening 112.

As best seen in FIG. 9*b*, insulator inserts 116 fit within each opening 112 of the support plate 110. Each insert 116 generally has a tubular body 118 with an annular flange 120 that circumscribes the center of the tubular body 118 at generally the longitudinal mid-section of the body 118. The inserts 116 are formed of an elastic material which has a thermal conductivity less than the metal forming the cylinder head 50 and the support plate 110. The elastic material preferably is a heat resistant rubber having low thermal conductivity, such as, for example, nitrile rubber. The material of the inserts 116 also desirably has a lower coefficient of expansion than that of the material which forms the cylinder head 50.

As seen in FIG. 9*b*, a mounting flange 122 is attached to each insert 116 such that the annular flange 120 of the insert 116 is interposed between the support plate 110 and the mounting flange 122. With reference to FIG. 9*c*, each mounting flange 122 generally has a parallelogram-like shape with rounded corners. The shape of the mounting flange 122 desirably corresponds to the shape of a standard mounting flange 124 (FIG. 2) on the outlet side of the carburetor 72.

As seen in FIG. 9*c*, the mounting flange 122 defines a central opening 126 sized to receive a portion of the tubular body 118 of the corresponding insert 116. A pair of threaded mounting holes 128 extend transversely through each mounting flange 122. The mounting holes 128 are positioned on opposite sides of central opening 126 at locations which corresponds to the locations of mounting holes on the carburetor mounting flange 124 (FIG. 2).

As best seen in FIG. 9*b*, each insert 116 couples one of the mounting flanges 122 to the support plate 110. The inserts 116 are vulcanized or otherwise bonded to the support plate 110 and to the corresponding mounting flange 122 to connect the mounting flange 122 to the support plate 110. As seen in FIGS. 9*a* and 9*c*, each mounting flange 122 is orientated identically to each other on the support plate 110, and is positioned to extend to the sides of the support plate 110. The position of the flanges 122 desirably corresponds to the orientation of the carburetor mounting flanges 124 when properly orientated in the engine assembly.

As seen in FIG. 9*b*, the length of the tubular body 118 of the insert 116 desirably is equal to the combined thicknesses of the support plate 110, the insert annular flange 120 and the mounting flange 122. In this manner, the insert 116 defines a passageway S through the insulator 14. The size (e.g., diameter) of the passageway S desirably generally equals the size of the outlet opening of the corresponding carburetor 72 and the inlet opening of the corresponding intake pipe 60.

With reference to FIGS. 2 and 3, bolts 130 attach the insulator 14 to the flange 62 of the intake manifold 58. The bolts 130 pass through the mounting holes in the intake manifold flange 62 and thread into the mounting holes 114 (FIG. 9*a*) in the insulator support plate 110 to secure the insulator 14 to the intake manifold 58.

The carburetors 72 and induction pipes 70 attach on the opposite side of the insulator 14. In the illustrated embodiment, the bolts 92 pass through the mounting holes in the induction pipe flanges 88, through the interposed support plate 94, and through the mounting holes of the inlet end flanges 91 of the carburetors 72. The bolts 92 also extend through the carburetor body, pass through mounting hole in the carburetor outlet end flanges 124 and thread into the mounting holes 128 of the mounting flanges 122 of the insulator 14. The bolts 92 thus secure the carburetors 92 and support plate 94 between the induction pipe flanges 92 and the intake manifold flange 62 to generally seal the induction pathways between these components.

The insulator 14, made in part of an elastic material having low thermal conductivity, generally thermally decouples the carburetor 72 from engine to reduce conduction of engine heat to the carburetors 72. That is, the insulator 14 acts as an effective barrier to conductive heat because it defines the only conductive pathway between the intake manifold 58 and the charge formers 72. The charge formers 72 thus conduct less heat than with prior insulator designs.

In addition, the elastic nature of the insulator inserts 116 allows the insulator 14 to as the intake manifold 58 thermally expands. The distance between the charge formers 72, which are on the opposite side of the insulator 14, remains substantially unaffected by the thermal expansion of the intake manifold 58. The linkages 78, 86 and the support plates 94, 96 between the charge formers 72 generally maintain the spacing between the charge formers 72. The elastic insulator inserts 116 thus generally absorb the resultant stresses that result because of the mismatch in thermal expansion between the intake manifold 58 and these linkages 78, 86 and support plates 94, 96. As a result, the linkages 78, 86 are generally unaffected by the thermal expansion of the intake manifold 58, and the position of the throttle valves remain synchronized for stabilized running of the engine.

The elastic nature of the insulator inserts 116 also decouples to some extent the charge formers 72 from engine vibrations in the cylinder head 50. The elastic insulator inserts 116 tend to dampen such vibrations. Thus, less vibrational energy propagates across the insulator 14 to the charge formers 72.

Figures 10A, 10B, 10C:
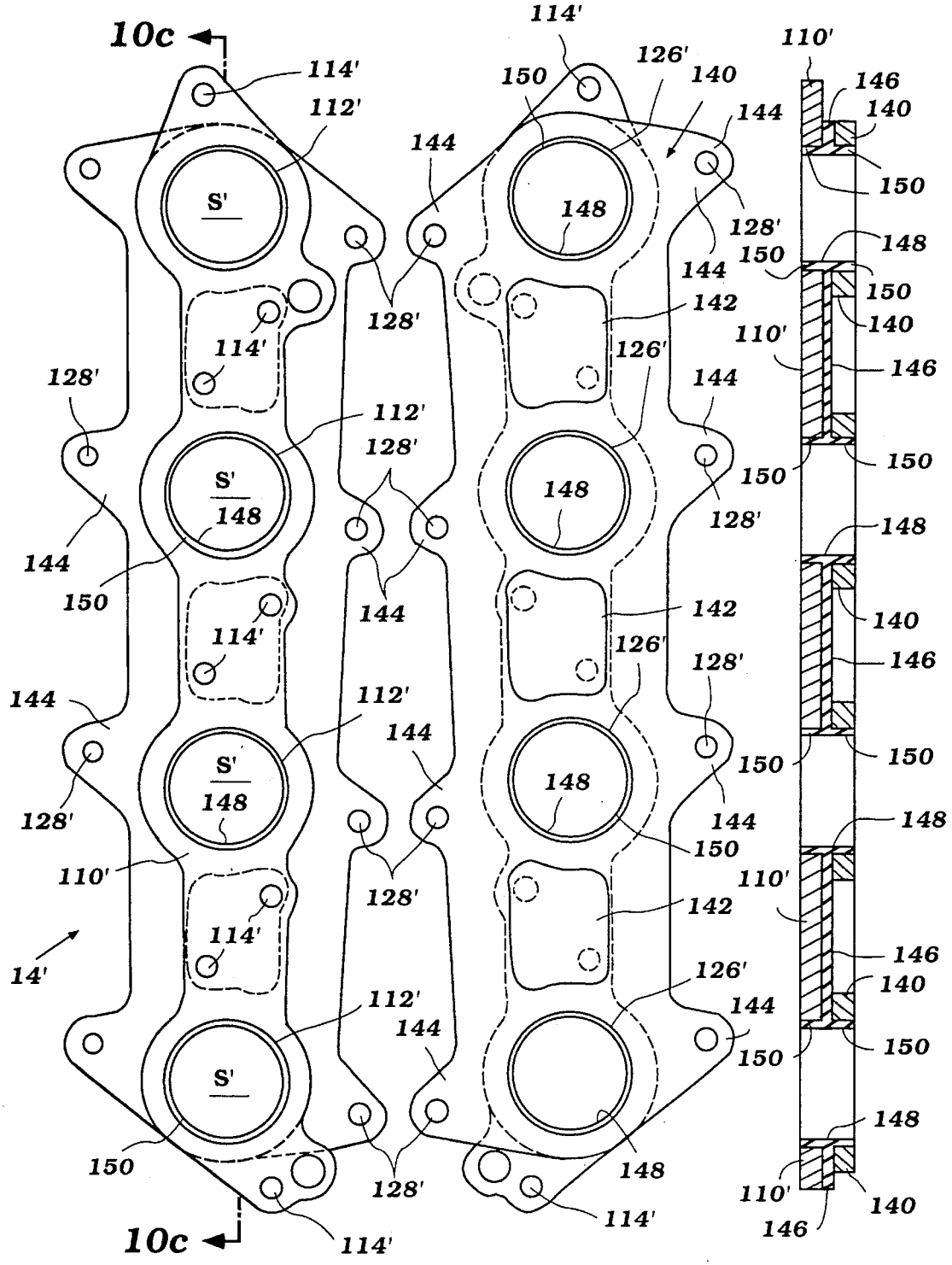
FIG. 10*a* is a side elevational view of an insulator in accordance with another preferred embodiment of the present invention, as viewed from an outlet side.
FIG. 10*b* is a side elevational view of the insulator of FIG. 10*a* as viewed from an opposite inlet side.
FIG. 10*c* is a cross-sectional view of the insulator of FIG. 10*a* taken along line 10*c*—10*c*.

FIGS. 10*a* through 10*c* illustrate an insulator in accordance with another preferred embodiment of the present invention. Where appropriate, like numbers with an ' suffix have been used to indicate like parts of the two embodiments of the insulator for ease of understanding.

As best seen in FIG. 10*a*, the insulator 14' includes a support plate 110'. The support plate 110' has a shape which is generally commensurate with the shape of the intake manifold flange 62. A plurality of openings 112' pass through the support plate 110. The spacing between the openings 112' generally corresponds with the inlet openings of the intake pipes 60. The openings 112' desirable have a size (e.g., a diameter) slightly larger than the intake pipe opening. The support plate 110' also defines a plurality of threaded mounting holes 114' which correspond with the position of through holes on the intake manifold flange 62. As seen in FIG. 10*a*, the mounting holes 114' are desirably arranged in pairings, with one hole 114' of the pair positioned above one of the openings 112' and the other hole positioned below the opening 112'.

With reference to FIG. 10*b*, the insulator 14' also includes a carburetor mounting plate 140. The mounting plate 140 has a length generally equal to the length of the support plate 110', and is wider than the support plate 110'. The mounting plate 140 defines a series of aligned opening 126'. The size and position of the openings 126' correspond to the openings of the support plate 110'. Positioned between the openings 126', the mounting plate 140 also defines a series of apertures 142, the purpose of which is explained below.

The mounting plate 140 includes a plurality of wing sections 144 which extend outwardly from the center of the openings 126'. One wing section 144 extends outwardly to each side of the openings 126'. The shape and position of the wing sections 144 generally corresponds with correspondingly shaped projections on the standard mounting flanges 124 of the carburetors 72.

A pair of threaded mounting holes 128' extend through the mounting plate 140. One mounting hole 128' is positioned on each wing section 144 to the side of one of the openings 126'. The position of the mounting holes 128' desirably corresponds to the location of a mounting hole on the carburetor mounting flange 124 (FIG. 2).

As best seen in FIG. 10*c*, an insulator plate 146 is interposed between the support plate 110' and the mounting plate 140. The insulator plate 146 defines a series of openings 148 which generally correspond in size and position with the openings 112', 126' of the support plate 110' and the mounting plate 140. The openings 148 desirably are slightly smaller than the openings 112', 126' of the support plate 110' and mounting plate 140, and generally match the diameters of the openings of the carburetors 72 and the intake pipes 60.

An integral annular collar 150 extends transversely from the insulator plate 146 on each side of each openings 148. Each annular collar 150 has an inner diameter generally equal that of the insulator plate openings 148. The outer diameter of each collar 150 generally matches the diameter of the mounting plate openings 126' and the support plate openings 112'.

As seen in FIG. 10*c*, each annular collar 150 fits within an opening 112', 126' of the support plate 110' or the mounting plate 140. Each annular collar 150 also has a length (i.e., the distance by which the collar 150 projects from the surface of the insulator plate 146) generally equal to the thickness of the mounting plate 110' or the support plate 140, depending upon which side of the insulator plate 146 the annular collars 150 project. In the illustrated embodiment, the support plate 110' and the mounting plate 140 generally have the same thickness.

When interposed between the mounting plate 140 and the support plate 110', the insulator plate 146 defines passageways S' through the insulator 14' which are formed between corresponding annular collars 150 and openings 148 of the insulator plate 146. The insulator plate 148 is formed of an elastic material which has a thermal conductivity less than the material forming the cylinder head 50 and the support plate 110'. The elastic material preferably is a heat resistant rubber having low thermal conductivity, such as, for example, nitrile rubber.

As best seen in FIG. 10*c*, the insulator plate 146 couples the mounting plate 140 to the support plate 110'. Specifically, the insulator plate 146 is vulcanized or otherwise bonded to the support plate 110' and to the mounting plate 140 to connect together these components. As also seen in this figure, the aperture 142 of the mounting plate 140 reduce the contact area between the mounting plate 140 and the insulator plate 146 to reduce the area of the insulator 14 through which heat can conduct.

As seen in FIGS. 10*a* and 10*b*, each wing section 144 of the mounting plate 140 is orientated to correspond to the mounting holes of the carburetor flanges 124 when properly orientated in the engine assembly.

The assemblage of the two above-described embodiments of the insulator between the induction system 64 and the intake manifold 58 is understood to be substantially identical. Thus, the insulator 14' of FIG. 10*a* is installed in the engine 12 in a like manner to that described above in connection with the insulator 14 of FIG. 9*a*. In view of the prior description, it is contemplated that those skilled in the art can readily employ the insulator 14' in the engine 12, and a further description of the engine assembly is not necessary.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. An intake system comprising a charge former, an intake conduit, and an insulator interposed between said charge former and said intake conduit, said insulator comprising a rigid support member directly connected to said intake conduit, at least one rigid mounting member directly connected to said charge former, and an elastic insulator member interposed between said support member and said mounting member, said insulator member forming the sole mechanical connection joining together said charge former and said intake conduit.

2. An intake system as in claim 1, wherein said mounting member of said insulator is oriented with respect to said support member such that a portion of said mounting member overlaps a portion of said support member, and said insulator member has a shape which is at least coextensive with said portions of said mounting member and said support member.

3. An intake system as in claim 1, wherein said support member includes an opening which is positioned opposite of an opening of said mounting member, said insulator member defining an opening which is circumscribed on either side by a pair of tubular sections, one tubular section being fit into said opening of said support member and the other tubular section fit into said opening of said mounting member.

4. An intake system as in claim 3, wherein said opening of said insulator member is formed in a flange which extends generally parallel to a common axis of said tubular projections, said flange lying between said support member and said mounting member.

5. An intake system as in claim 3, wherein said opening of said insulator member is formed in a central plate which extends between said support member and said mounting member.

6. An intake system as in claim 1, wherein said insulator forms the sole mechanical connection joining a plurality of charge formers with at least said intake conduit.

7. An intake system as in claim 1, wherein said insulator forms the sole mechanical connection joining at least said charge former with a plurality of intake conduits.

8. An intake system as in claim 1, wherein said insulator forms the sole mechanical connection joining together a plurality of said charge formers and a plurality of said intake conduits.

9. An insulator for coupling at least one charge former to an intake conduit, said insulator comprising a rigid support member for direct mechanical connection to an intake conduit, at least one rigid mounting member for direct mechanical connection to the charge former, and an elastic insulator member being interposed between and forming the sole connection joining together said support member and said mounting member, said insulator member having a generally tubular body which is circumscribed by an annular flange.

10. An insulator for coupling at least one charger former to an intake conduit, said insulator comprising a rigid support member for direct mechanical connection to the intake conduit, at least one rigid mounting member for direct mechanical connection to the charge former, and an elastic insulator member being interposed between and forming the sole connection joining together said support member and said mounting member, said support member and said mounting member each defining at least one opening, said opening of said support member being positioned opposite of said opening of said mounting member, said insulator member defining an opening which is circumscribed on either side by a pair of tubular projections, one tubular projection being fit into said opening of said support member and the other tubular projection being fit into said opening of said mounting member.

11. The insulator of claim 10, wherein said insulator member has a lower thermal conductivity than that of the intake conduit.

12. The insulator of claim 10, wherein the charge former includes an outlet opening and the intake conduit includes an inlet opening, and said insulator member defines a passageway through said tubular projections which extends between said outlet opening of the charge former and said inlet opening of the intake conduit.

13. The insulator of claim 10, wherein said mounting member is oriented with respect to said support member such that a portion of said mounting member overlaps a portion of said support member, and said insulator member has a shape which is at least coextensive with said portions of said mounting member and said support member which overlay each other.

14. The insulator of claim 10, wherein said support member is adapted to couple to a plurality of intake conduits.

15. The insulator of claim 14, wherein a plurality of insulator members are interposed between a plurality of mounting members and said support member, each insulator member joining a corresponding mounting member to said support member.

16. The insulator of claim 15, wherein each of said plurality of mounting members is attached to a charge former, each charge former including a mounting flange, and each mounting member has a corresponding shape to said mounting flange of the charge former.

17. The insulator of claim 10, wherein said mounting member is adapted to support a plurality of charge formers, said mounting member defining a series of aligned openings which correspond with outlet openings of the plurality of charge formers.

18. The insulator of claim 10, wherein said insulator member is bonded to said support member and to said mounting member.

19. The insulator of claim 18, wherein said insulator member is formed of a heat resistant material.

20. The insulator of claim 19, wherein said insulator member is formed of nitrile rubber.

21. The insulator of claim 10, wherein said insulator couples a plurality of charge formers to a plurality of intake conduits, and said charge formers are interconnected by a common support plate.

22. An insulator for coupling at least one charge former to an intake conduit, said insulator comprising a rigid support member for direct mechanical connection to the intake conduit, at least one rigid mounting member for direct mechanical connection to the charge former, and an elastic insulator member being interposed between and forming the sole connection joining together said support member and said mounting member, said insulator member including a central plate which defines at least one opening and a pair of tubular projections which circumscribe the opening and extend outward from opposite sides of said central plate.

* * * * *